US005396715A

United States Patent [19]

Smith

[11] Patent Number: 5,396,715

[45] Date of Patent: Mar. 14, 1995

[54] MICROWAVE CLOTHES DRYER AND METHOD WITH FIRE PROTECTION

[75] Inventor: Richard D. Smith, Palo Alto, Calif.

[73] Assignee: Electric Power Research Institute, Palo Alto, Calif.

[21] Appl. No.: 257,180

[22] Filed: Jun. 9, 1994

[51] Int. Cl.[6] ..... F26B 3/34

[52] U.S. Cl. ..... 34/261; 34/494; 34/544; 219/710

[58] Field of Search ..... 34/544, 259, 260, 261, 34/265, 494; 219/678, 710–713

[56] References Cited

U.S. PATENT DOCUMENTS

| | | | |
|---|---|---|---|
| 3,426,439 | 2/1969 | Ryman et al. | 34/1 |
| 3,771,234 | 11/1973 | Forster et al. | 34/1 |
| 3,958,340 | 5/1976 | Meyers | 34/1 |
| 4,103,431 | 8/1978 | Levinson | 34/4 |
| 4,250,628 | 2/1981 | Smith et al. | 34/1 |
| 4,365,422 | 12/1982 | Kawaguchi | 34/1 |
| 4,490,923 | 1/1985 | Thomas | 34/1 |
| 4,746,968 | 5/1988 | Wear et al. | 219/10.55 |
| 4,765,066 | 8/1988 | Yoon | 34/1 |
| 5,187,879 | 2/1993 | Holst | 34/1 DD |
| 5,220,813 | 6/1993 | Chen et al. | 68/355 |

FOREIGN PATENT DOCUMENTS

| | | | |
|---|---|---|---|
| 2656046 | 6/1978 | Germany | 134/494 |
| 63-286188 | 11/1988 | Japan | 34/261 |

*Primary Examiner*—Denise L. Gromada
*Attorney, Agent, or Firm*—Flehr, Hohbach, Test, Albritton & Herbert

[57] ABSTRACT

Microwave clothes dryer and method in which water is introduced into the chamber in response to detection of an impending fire to immediately increase the moisture content of the clothes throughout the chamber to a level which will not sustain combustion.

6 Claims, 1 Drawing Sheet

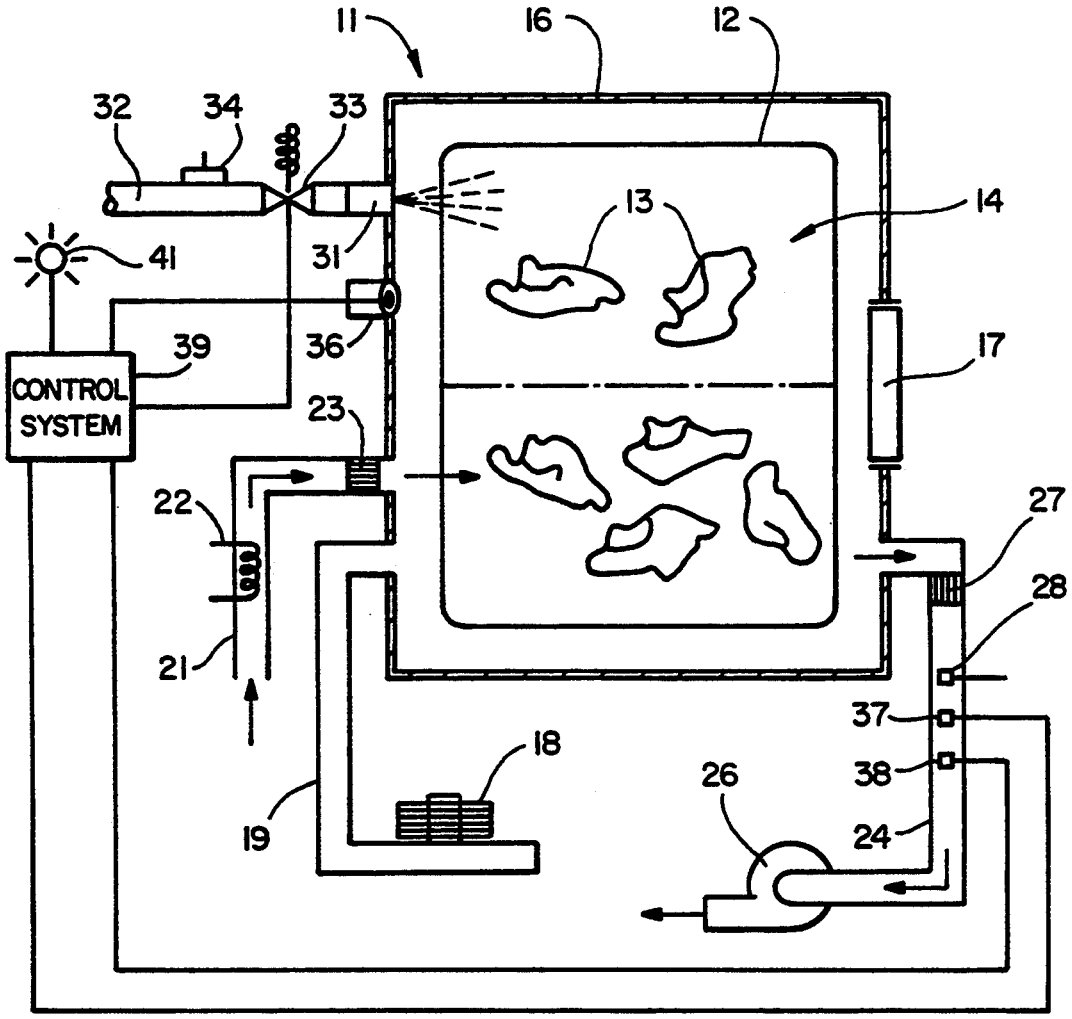
11
16
12
32
34
33
13
14
41
31
36
39
17
CONTROL SYSTEM
23
22
27
28
21
37
18
38
26
19
24

MICROWAVE CLOTHES DRYER AND METHOD WITH FIRE PROTECTION

This invention pertains generally to microwave clothes dryers and, more particularly, to the prevention of fires in such dryers.

A microwave clothes dryer uses a combination of microwave energy and hot air to dry clothes. The microwave energy heats the water in the clothes and vaporizes it, and a flow of hot air carries the moisture from the dryer.

While metal buttons and zippers generally do not overheat in a microwave dryer, some types of so-called tramp metals will heat excessively and cause burn spots, which can lead to dryer fires. At an operating frequency of 2450 MHz, for example, objects such as bobby bins, nails and wire ties will easily heat enough to burn holes in clothes. At frequencies of both 2450 MHz and 915 MHz, golf pencils are heated beyond the ignition temperature of cloth and cause burns. The metal objects heat so quickly that the adjacent cloth can ignite even though the remainder of the load in the dryer is quite damp. While some localized damage to the clothes may be tolerated, a dryer fire is totally unacceptable.

Heretofore, a variety of sensors have been employed for detecting the onset of local combustion in dryers. Such sensors have included infrared heat sensors, fume sensors, temperature sensors and light sensors. Used alone or in combination, these sensors cause the dryer to shut down and display a warning that combustion has occurred. They do not, however, cool the source of ignition, extinguish any combustion which might have started, or prevent the remaining clothes in the dryer from catching on fire.

It is in general an object of the invention to provide a new and improved microwave clothes dryer and method in which the possibility of a clothes fire is effectively eliminated.

Another object of the invention is to provide a microwave clothes dryer and method of the above character which overcome the limitations and disadvantages of microwave clothes dryers heretofore provided.

These and other objects are achieved in accordance with the invention by providing a microwave clothes dryer and method in which water is introduced into the chamber in response to detection of an impending fire to immediately increase the moisture content of the clothes throughout the chamber to a level which will not sustain combustion.

The single figure of drawing is cross-sectional view, somewhat schematic, of one embodiment of a microwave clothes dryer incorporating the invention.

In the drawing, the invention is illustrated in connection with a microwave dryer 11 having a rotating drum 12 for holding clothes 13 to be dried within a chamber 14. The chamber is surrounded by a metal enclosure, or Faraday cage, 16 which prevents microwaves from escaping from the dryer. A door 17 in the enclosure provides access to the drum for insertion and removal of the clothes.

Microwave energy for evaporating water in the clothes is generated a magnetron 18 and supplied to the chamber through a waveguide 19. Heated air is supplied to the chamber through an inlet duct 21. In the embodiment illustrated, the air is preheated by waste heat from the magnetron, then heated further by an electrical resistance heater 22 as it passes through the duct.

However, if desired, it can be heated by other suitable means such as a gas heater. A microwave barrier 23 at the inner end of the duct prevents microwave energy from escaping from the chamber through the duct.

An exhaust system comprising an exhaust duct 24 and an exhaust fan 26 communicate with the chamber through a second microwave barrier 27. As the air passes through the tumbling clothes, it picks up moisture which has been vaporized by the microwaves. This air is withdrawn through the exhaust system and discharged to the atmosphere.

A humidity sensor 28 is disposed in the exhaust duct to monitor the moisture content of the air leaving the dryer. This sensor is connected to a control system of conventional design (not shown) which shuts off the dryer when the moisture content indicates that the clothes have been dried to the desired level.

A spray nozzle 31 is positioned for spraying water onto the clothes in the dryer. This nozzle is connected to a water line 32 which is connected to a source of pressurized water (not shown), with a solenoid operated valve 33 controlling delivery of water from the line to the nozzle. A pressure sensor 34 monitors the water pressure in the line and prevents the dryer from operating unless water is available for the spray nozzle.

Means is provided for detecting the occurrence of heating which might lead to the outbreak of a fire in the clothes in the dryer. This means includes an infrared sensor 36 for detecting hot spots in the dryer chamber, a fume detector 37 for detecting smoke and other products of combustion in the exhaust duct, and a temperature sensor 38 for detecting unusually high temperatures in the exhaust duct. These sensors are connected to a control system 39 which opens the solenoid valve 33 and shuts down the rest of the system when it appears that a fire may be starting. The valve remains open long enough to wet the clothes to a 100 percent moisture content, which prevents them from catching on fire. A warning light 41 is illuminated by the control system to provide a visual indication that the system needs attention.

Operation and use of the system, and therein the method of the invention, are as follows. Clothes to be dried are placed in the drum, the door is closed, and the dryer is turned on. During normal operation, the microwave energy evaporates the water in the clothes, and the moisture is carried out of the chamber by the flow of hot air.

In the event that heating of a tramp material is detected, valve 33 is opened, and the remainder of the system (i.e., the drum motor, magnetron, air heater and exhaust fan) is shut down. The valve remains open for a period of time sufficient to thoroughly soak the clothes, then closes. The water cools down the hot spot, extinguishes any burning which may have occurred, and prevents the remainder of the clothes from catching on fire. The warning light alerts the operator to remove the tramp material and restart the dryer. Any residual water which is not absorbed by the clothes during the deluge will remain in the bottom of the chamber and be evaporated during a subsequent drying cycle.

It is apparent from the foregoing that a new and improved microwave clothes dryer and method have been provided. While only certain presently preferred embodiments have been described in detail, as will be apparent to those familiar with the art, certain changes and modifications can be made without departing from the scope of the invention as defined by the following claims.

I claim:

1. In a microwave clothes dryer: a chamber for holding clothes to be dried, means for introducing microwave energy into the chamber to evaporate moisture in the clothes, means for detecting an impending fire in the chamber, and means responsive to detection of an impending fire for introducing water into the chamber to wet the clothes throughout the chamber to a moisture content on the order of 100 percent.

2. In a method of drying clothes, the steps of: placing the clothes in a drying chamber, introducing microwave energy into the chamber to evaporate moisture in the clothes, detecting an impending fire in the chamber, and introducing water into the chamber in response to detection of an impending fire to wet the clothes throughout the chamber to a moisture content on the order of 100 percent.

3. In a microwave clothes dryer: a chamber for holding clothes to be dried, means for introducing microwave energy into the chamber to evaporate moisture in the clothes, a nozzle for spraying water into the chamber to wet the clothes, means for detecting an impending fire in the chamber, and means responsive to detection of an impending fire for supplying water to the nozzle.

4. The microwave clothes dryer of claim 3 wherein the means for supplying water to the nozzle includes a source of pressurized water and a valve controlling communication between the source and the nozzle.

5. The microwave clothes dryer of claim 4 further including means responsive to water pressure in the source for inhibiting operation of the dryer when the water pressure is below a predetermined level.

6. The microwave clothes dryer of claim 3 wherein the means for detecting an impending fire is selected from the group consisting of an infrared heat sensor, a fume detector, a temperature sensor, and combinations thereof.

* * * * *